United States Patent [19]

Calviac

[11] 3,945,355

[45] Mar. 23, 1976

[54] CAMSHAFT DEVICE FOR AN INTERNAL COMBUSTION ENGINE HAVING A VARIABLE DISTRIBUTION

[75] Inventor: Jean-Pierre Calviac, Maisons-Laffitte, France

[73] Assignees: Automobiles Peugeot, Paris; Regie Nationale des Usines Renault, Boulogne-Billancourt, both of France

[22] Filed: Mar. 31, 1975

[21] Appl. No.: 563,519

[30] Foreign Application Priority Data

Apr. 2, 1974 France ..... 74.11718

[52] U.S. Cl. ..... 123/90.18; 123/90.13; 123/90.15

[51] Int. Cl.[2] ..... F01L 1/34

[58] Field of Search..... 123/90.18, 90.12, 90.13, 123/90.15, 90.17; 74/863, 865

[56] References Cited

UNITED STATES PATENTS

| | | | |
|---|---|---|---|
| 1,863,875 | 6/1932 | Rabezzana | 123/90.18 |
| 2,670,594 | 3/1954 | Crooks | 123/90.18 |
| 2,969,051 | 1/1961 | Webster | 123/90.18 |
| 2,980,089 | 4/1961 | Sampietro | 123/90.18 |
| 3,113,561 | 12/1963 | Heintz | 123/90.18 |
| 3,481,314 | 12/1969 | Le Crenn | 123/90.18 |
| 3,633,554 | 1/1972 | Nakajima | 123/90.18 |
| 3,730,150 | 5/1973 | Codner | 123/90.18 |
| 3,882,739 | 5/1975 | Eltze | 74/863 |

*Primary Examiner*—Charles J. Myhre
*Assistant Examiner*—Daniel J. O'Connor
*Attorney, Agent, or Firm*—Burns, Doane, Swecker & Mathis

[57] ABSTRACT

A capsule connected to a first source of pressure representing the load of the engine and to a second source of pressure representing the running speed of the engine has its diaphragm connected to a slide valve of a pressure modulator. The latter controls the pressure of lubricating oil in a chamber defined between a piston and a fixed chamber, the chamber being supplied with the oil through a constricted orifice. A camshaft is slidably and rotatably mounted and slidable by the piston. Changes in the pressure of the two sources change the axial position of the camshaft.

10 Claims, 2 Drawing Figures

CAMSHAFT DEVICE FOR AN INTERNAL COMBUSTION ENGINE HAVING A VARIABLE DISTRIBUTION

Figures 1, 2:
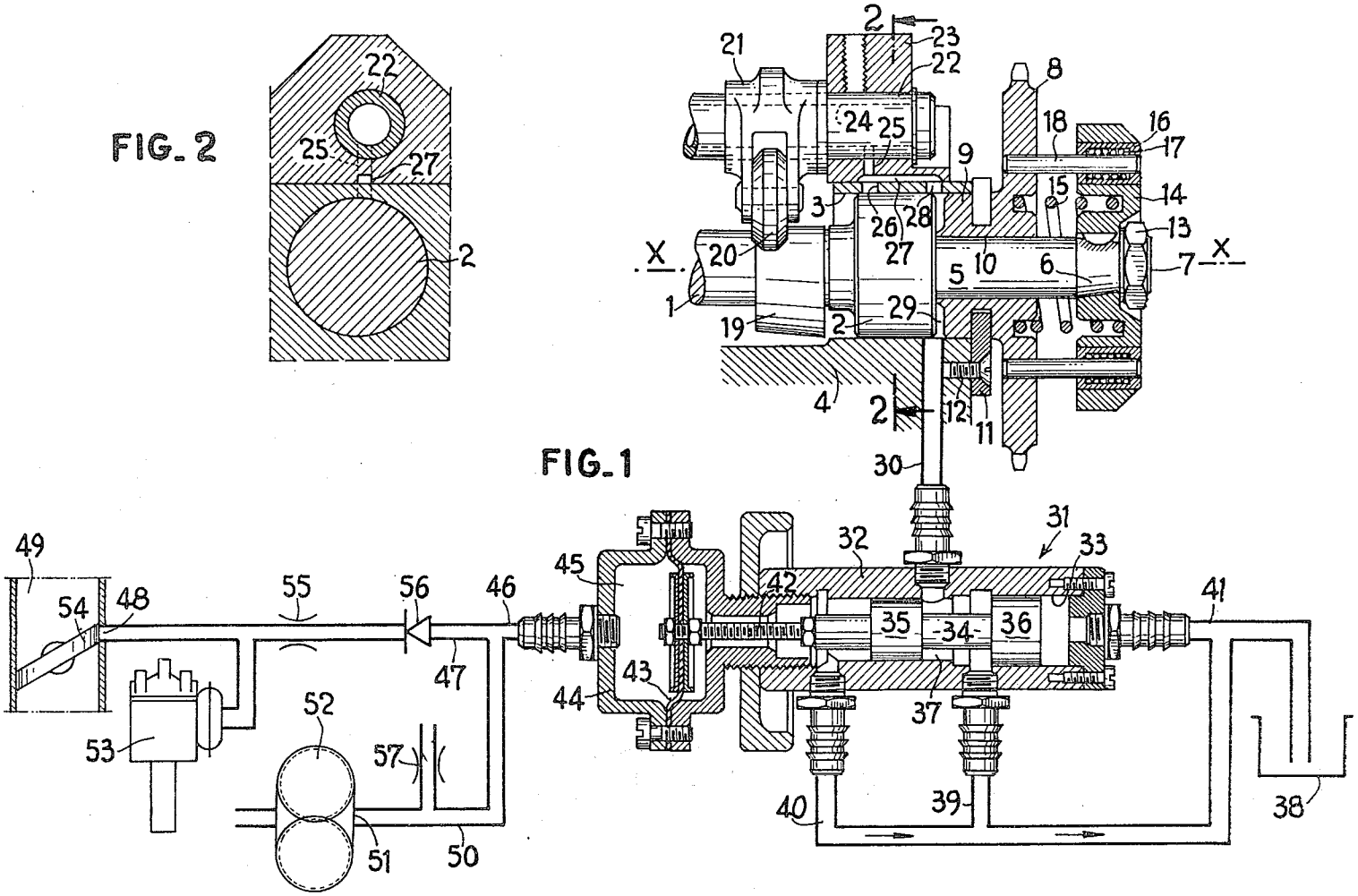

The present invention relates to a camshaft device provided with a mechanism for modifying the regulation of the distribution of an internal combustion engine in accordance with certain parameters of operation.

It is known that in an internal combustion engine having a distribution by means of valves, the setting of the opening and closing of the induction and exhaust valves is of high importance in the obtainment of good efficiency and the minimum production of harmful gases. In order to obtain the best results in all cases of utilisation of the engine, the setting must be varied progressively in accordance with certain parameters of operation and in particular the speed and load.

To obtain this result, there may be provided a camshaft having, on one hand, cams having an evolutive profile in length and, on the other, a piston cooperating with a fixed cylinder and defining a chamber in which there is made to act a liquid pressure whose value is a function of both the speed and the load of the engine.

An object of the present invention is to provide a particularly simple device which permits obtaining a very progressive and precise regulation of the movement of the camshaft which is a substantial improvement over known devices.

The invention is applied to a camshaft device in which the shaft is rotatably and axially slidably mounted and actuated by a piston cooperating with a fixed cylinder so as to form a chamber which is fed through a constricted orifice with the lubricating oil of the engine and connected to the discharge through a modulator provided with a slide valve which variably makes a discharge orifice.

According to the invention, the slide valve is integral with a diaphragm of a pressure-responsive capsule connected on one hand to a first source of pressure representing the load of the engine and, on the other, to a second source of pressure representing the speed of the engine.

In one embodiment, a chamber of the capsule is connected to the induction pipe of the engine and to the suction side of a volumetric vaccuum pump driven by the engine.

According to another feature of the invention, the camshaft is freely slidable in a cylindrical bore of its drive pinion and is integral with a ring carrying sleeves containing balls and having axes parallel to the axis of the camshaft and in which are guided posts which are integral with the pinion and have axes also parallel to the axis of the camshaft.

Further features and advantages of the invention and its operation will be described hereinafter with reference to the accompanying drawing given by way of example and in which:

FIG. 1 is a sectional view of a part of a camshaft device of an internal combustion engine provided with regulating and driving means according to the invention, and FIG. 2 is a partial sectional view taken on line 2—2 of FIG. 1.

In FIG. 1 there is seen one end of a camshaft 1 having an axis X—X carrying a journal 2 rotating in a bearing 3 formed in the cylinder-head 4 of an engine. The camshaft is also supported and guided in the known manner by other journals and bearings (not shown).

Outside the journal 2, the camshaft 1 is axially extended by a cylindrical part 5, a conical part 6 and a screwthreaded part 7.

A gear pinion 8, driven in the conventional manner by the crankshaft of the engine (not shown), has a hub 9 which is journalled in the bearing 3 and a bore 10 which cooperates with the cylindrical part 5 of the camshaft. The hub 9 of the pinion has a recess in which a forkshaped member 11 is engaged, this member being secured to the cylinder-head 4 by a screw 12. This member has for function to hold the pinion axially stationary. Fixed to the conical part 6 of the camshaft by a nut 13, is a ring 14 and a spring 15 is compressed between the latter and the pinion 8.

Evenly spaced around the axis X—X and disposed in the thickness of the ring 14 are sleeves 16 whose axes are parallel with the axis of the camshaft. These sleeves have guide cages for balls 17 these cages forming longitudinal raceways connected by curved parts. An example of this type of sleeve having a circulation of balls is given in French Pat. No. 1,410,928.

Posts 18 integral at one end with the pinion 8 are freely slidable without play in each of the sleeves 16.

The camshaft 1 carries cams such as 19 which have an evolutive profile in length. A roller 20 carried by one end of a rocker 21 pivotably mounted on a shaft 22 bears against each cam 19. The other end of this rocker cooperates with the stem of an induction or exhaust valve (not shown).

The rocker shaft 22 is secured in supports such as 23 which are secured to the cylinder-head 4. In the known manner, this shaft 22 is hollow and its central cavity 24, supplied with oil under pressure by the pump of the engine, performs the function of a passageway for lubricating the rockers and the bearings of the camshaft. Thus the bearing 3 receives oil under pressure from the passageway 24 through orifices 25, 26.

The orifice 25 also communicates by way of a constricted passage 27 with an orifice 28 which communicates inside the bearing 3 with a chamber 29 formed between the journal 2 and the hub 9 of the pinion 8. The chamber 29 is connected by a conduit 30 to a pressure modulator 31.

The latter comprises a cylindrical body 32 provided with a stepped bore 33 in which is slidable a slide valve 34 having a first piston 35 and a second piston 36 of slightly larger diameter than the first piston. The conduit 30 leads to a chamber 37 formed in the bore 33 between the pistons 35 and 36. The chamber 37 may be connected to the oil pump 38 of the engine by a conduit 39 and conduits 40 and 41 receive any leakage of oil which reaches the ends of the modulator 31.

The slide valve 34 is extended by a rod 42 secured to a flexible diaphragm 43 of a suction capsule 44 which forms with the diaphragm a chamber 45. The latter communicates by way of a conduit 46, on one hand, with a conduit 47 which leads to a suction take-off 48 located on the induction pipe 49 of the engine and, on the other hand, with a conduit 50 which leads to the suction orifice 51 of a volumetric pump 52 driven by the engine.

The pressure take-off 48, which may be that employed for correcting the advance of an ignition distributor 53, is disposed in the induction pipe 49 in such manner as to be closed when the throttle 54 is closed and to be downstream of this throttle when it opens.

Disposed in the conduit 47 is a calibrated orifice 55 and a check-valve 56 which closes when the suction in the conduit 46 is higher than that existing in the region of the suction take-off 48.

The conduit 50 communicates with the atmosphere through a calibrated orifice 57.

The device just described operates in the following manner:

When the suction in the chamber 45 is very low, for example when the engine is sliding, the throttle 54 being closed, the slide valve 34 of the modulator 31 is urged toward the right as viewed in the drawing owing to the difference in the diameters of the pistons 35 and 36. In this illustrated position, the slide valve 36 uncovers the orifice of the discharge conduit 39 so that the oil pressure existing in the chamber 29 is very low and insufficient to compress the spring 15. The active profile of the cam 19 is then that which is facing the roller 20 for this position.

The higher the suction in the chamber 45 the more the slide valve 34 is driven toward the left and the more it closes the orifice of the discharge conduit 39. Consequently, there is an increase in the pressure in the chamber 37 which permits ensuring, owing to the difference in the diameters of the pistons 35 and 36, the equilibrium of the slide valve 34 for each suction value.

Simultaneously, this increase in pressure in the chamber 37 is transmitted to the chamber 39 and this has for effect to urge the camshaft 1 toward the left and compress the spring 15. This movement is particularily gradual owing to the absence of sliding friction between the camshaft 1 and the pinion 8 so that for each value of the suction in the chamber 45 there is always the same axial position of the camshaft 1.

The position of equilibrium of the camshaft therefore takes into account both the load and speed of the engine, since the suction in the chamber 45 is a function of both the suction due the vaccuum pump 52 whose speed is directly proportional to the speed of the engine and of the suction in the pipe 49 which is directly related to the load.

This permits obtaining a more effective and more gradual regulation, the absence of friction resulting from the particular arrangement being essential to the obtainment of this precision since the variations in pressure are relatively low and would not be responded to if the forces opposing the axial displacement of the camshaft were too large.

Having now described my invention what I claim as new and desire to secure by Letters Patent is:

1. In a camshaft device for an internal combustion engine having a variable distribution comprising means defining a fixed structure, a camshaft rotatably and axially slidably mounted relative to the structure, a fixed cylinder, a piston slidable in the fixed cylinder and defining with the cylinder a chamber, passage means including a constricted orifice for putting the chamber in communication with lubricating oil of the engine, an oil pressure modulator comprising a member defining an oil discharge orifice and a slide valve cooperative with the member to mask the discharge orifice to an extent which varies with the position of the slide valve relative to the member; and passage means putting the chamber in communication with the discharge orifice; the provision of a pressure responsive capsule having a movable diaphragm which is connected to shift the slide valve relative to the member of the modulator, a first source of pressure representing the load of the engine, a second source of pressure representing the speed of the engine and passage means putting the interior of the capsule in communication with the first and second sources of pressure.

2. A device as claimed in claim 1, wherein said first source is constituted by the induction pipe of the engine.

3. A device as claimed in claim 1, wherein said second source is constituted by the suction side of a vacuum pump driven by the engine.

4. A device as claimed in claim 3, wherein the induction pipe of the engine and the suction side of the pump are connected to the same chamber of the capsule.

5. A device as claimed in claim 2, wherein the suction take off on the induction pipe is disposed in such manner as to be closed when the throttle is closed and to be downstream of the throttle when the throttle opens.

6. A device as claimed in claim 1, wherein a calibrated orifice and a check valve are disposed in the passage means which connect the first source to the interior of the capsule.

7. In a camshaft device for an internal combustion engine having a variable distribution comprising means defining a fixed structure, a camshaft rotatably and axially slidably mounted relative to the structure, a fixed cylinder, a piston slidable in the fixed cylinder and defining with the cylinder a chamber, passage means including a constricted orifice for putting the chamber in communication with lubricating oil of the engine, an oil pressure modulator comprising a member defining an oil discharge orifice and a slide valve cooperative with the member to mask the discharge orifice to an extent which varies with the position of the slide valve relative to the member; and passage means putting the chamber in communication with the discharge orifice; the provision of a pressure responsive capsule having a movable disphragm which is connected to shift the slide valve relative to the member of the modulator, a first source of pressure representing the load of the engine, a second source of pressure representing the speed of the engine, passage means putting the interior of the capsule in communication with the first and second sources of pressure, a driven pinion slidably mounted on the camshaft, a ring integral with the camshaft, means carried by the ring and defining a cavity having a low coefficient of friction and an axis parallel to the camshaft, and an elongate member integral with the drive pinion and having an axis parallel to the camshaft and guided in the cavity.

8. A device as claimed in claim 7, wherein there are provided a plurality of said cavities evenly spaced apart around the camshaft and a plurality of said elongate members guided in said cavities.

9. A device as claimed in claim 7, wherein said cavity comprises longitudinal raceway means and balls combined with the raceways and rollingly engaging the elongate member.

10. A device as claimed in claim 7, wherein elastically yieldable means are interposed between the ring and the pinion and acts to bias the ring and pinion apart.

* * * * *